US007351121B2

(12) United States Patent
Xu

(10) Patent No.: US 7,351,121 B2
(45) Date of Patent: Apr. 1, 2008

(54) ELECTRICAL TERMINAL

(75) Inventor: Xiang Xu, Kuns Han (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/579,324

(22) PCT Filed: Nov. 19, 2004

(86) PCT No.: PCT/US2004/041354

§ 371 (c)(1),
(2), (4) Date: Mar. 12, 2007

(87) PCT Pub. No.: WO2005/053108

PCT Pub. Date: Jun. 9, 2005

(65) Prior Publication Data

US 2007/0275610 A1 Nov. 29, 2007

(30) Foreign Application Priority Data

Nov. 20, 2003 (CN) ..... 2003 2 0100683 U

(51) Int. Cl.
*H01R 11/09* (2006.01)

(52) U.S. Cl. ..... 439/824; 439/66

(58) Field of Classification Search ..... 439/700, 439/824, 66

See application file for complete search history.

(56) References Cited

U.S. PATENT DOCUMENTS 4,528,500 A 7/1985 Lightbody et al.
5,393,246 A 2/1995 Du
5,936,421 A 8/1999 Stowers et al.
6,046,597 A 4/2000 Barabi
6,953,348 B2 * 10/2005 Yanagisawa et al. ..... 439/66
7,114,996 B2 * 10/2006 Goodman et al. ..... 439/700
2004/0053539 A1 * 3/2004 Watanabe ..... 439/700
2005/0266734 A1 * 12/2005 Kazama ..... 439/700

FOREIGN PATENT DOCUMENTS

EP 1 172 658 A2 1/2002

* cited by examiner

*Primary Examiner*—Ross Gushi
(74) *Attorney, Agent, or Firm*—Charles S. Cohen

(57) ABSTRACT

An electrical terminal includes first and second contact members having outer pressure contacting end portions for pressure engaging a pair of spaced electrical devices. The contact members have enlarged inner end portions. A sleeve includes a through hole for slidably receiving the inner end portions of the contact members at opposite ends thereof. The through hole has opposite open ends through which the pressure contacting end portions of the contact members project. Restricted stops are formed at the open ends of the through holes for abutting the enlarged inner ends of the contact members to define outer limit positions of the pressure contacting end portions of the contact members. A biasing member is disposed in the through hole to resiliently bias the contact members in opposite directions. The invention contemplates that an outside diameter of the sleeve at a first end thereof be smaller than an outside diameter of the sleeve at a second end thereof. Thereby, the smaller diameter end is easily formed into a restricted stop, and the larger diameter end of the sleeve can be used for clamping and disassembling the terminal from an electrical device without damaging the sleeve.

7 Claims, 5 Drawing Sheets

ELECTRICAL TERMINAL

FIELD OF THE INVENTION

This invention generally relates to the art of electrical connectors and, particularly, to a double-ended pressure contacting terminal for establishing an electrical connection between two spaced electrical devices.

BACKGROUND OF THE INVENTION

As is known in the art, pressure contacting electrical terminals are used to form a conductive circuit between two electrical devices by pressure engagement therebetween, such as establishing a connection between a mobile phone and an antenna. During assembly, one end of the terminal first is pressure engaged with a first electrical device, and an opposite end of the terminal then is pressure engaged with the second electrical device, thereby establishing an electrical connection between the two electrical devices.

For instance, FIG. 1 shows a prior art electrical terminal, generally designated 10, of the character described above. The terminal includes a sleeve or housing 12 having an inner conductive liner 14 forming a through hole 16 through the housing. The through hole has opposite open ends 18. A pair of contact members 20 have outer pressure contacting end portions 20*a* and enlarged inner end portions 20*b*. The inner end portions are reciprocally mounted within through hole 16, while outer end portions 20*a* project through openings 18 and outwardly of the housing. A coil spring 22 is disposed within through hole 16 and has opposite ends in engagement with the enlarged inner end portions 20*b* of contact members 20 to bias the contact members in opposite directions. It can be seen that the outer pressure contacting end portions 20*a* of contact members 20 have identical lengths.

It can be seen in FIG. 1 that sleeve 12 has a uniform thickness or cross-sectional dimension, as indicated by double-headed arrow 24, which extends the entire length of the sleeve. This creates problems because inwardly directed flanges 26 are formed to provide restricted stops which abut the enlarged inner end portions 20*b* of contact members 20. The stops define the outer limit positions of outer end portions 20*a* of the contact members. During assembly, one of the contact members, along with coil spring 22, are inserted through hole 16 against the flange 26 which has been pre-formed on one end of the sleeve. The opposite contact member is inserted into the through hole, compressing the coil spring, and the flange 26 at the opposite end of the sleeve is formed inwardly, typically by a riveting or bending operation. This riveting or bending procedure is difficult due to the thickness of the sleeve. If the outer diameter (i.e., thickness) of the sleeve is reduced, the sleeve is easily bent or damaged by a clamp or other tool if it is desired to disassemble the entire terminal from an electrical device.

In other words, a problematic dilemma is created because, on the one hand, it is desirable to have a thin sleeve to facilitate the riveting or bending operation which forms flanges 26, but, on the other hand, it is desirable to have a thick sleeve for clamping and disassembling the terminal from an electrical device. The present invention solves these problems by providing a unique terminal with a sleeve or housing of varying dimensions.

SUMMARY OF THE INVENTION

An object, therefore, of the invention is to provide a new and improved electrical terminal of the character described.

In the exemplary embodiment of the invention, the terminal includes first and second contact members having outer pressure contacting end portions for pressure engaging a pair of spaced electrical devices. The contact members have enlarged inner end portions. A sleeve includes a through hole for slidably receiving the inner end portions of the contact members at opposite ends thereof. The through hole has opposite open ends through which the pressure contacting end portions of the contact members project. Restricted stops are formed at the open ends of the through hole for abutting the enlarged inner ends of the contact members to define outer limit positions of the pressure contacting end portions of the contact members. A biasing member is disposed in the through hole to resiliently bias the contact members in opposite directions. The invention contemplates that an outside diameter of the sleeve at a first end thereof be smaller than an outside diameter of the sleeve at a second end thereof. Thereby, the smaller diameter end is easily formed into a restricted stop, and the larger diameter end of the sleeve can be used for clamping and disassembling the terminal from an electrical device without damaging the sleeve.

As disclosed herein, the biasing member comprises a coil spring. The restricted stops comprise inwardly turned flanges of the sleeve at the opposite open ends thereof. The outer pressure contacting end portions of the contact members are dome shaped to present a rounded convex contact surfaces for engaging the electrical devices.

The invention contemplates that an electrical device be provided with a housing having a mounting cavity, with a fixed contact at a base of the cavity. The sleeve is mounted in the cavity with the smaller diameter end of the sleeve projecting into the cavity and the larger diameter end of the sleeve projecting outside the cavity. The pressure contacting end of the contact member at the smaller diameter end of the sleeve is resiliently biased against the fixed contact at the base of the cavity.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
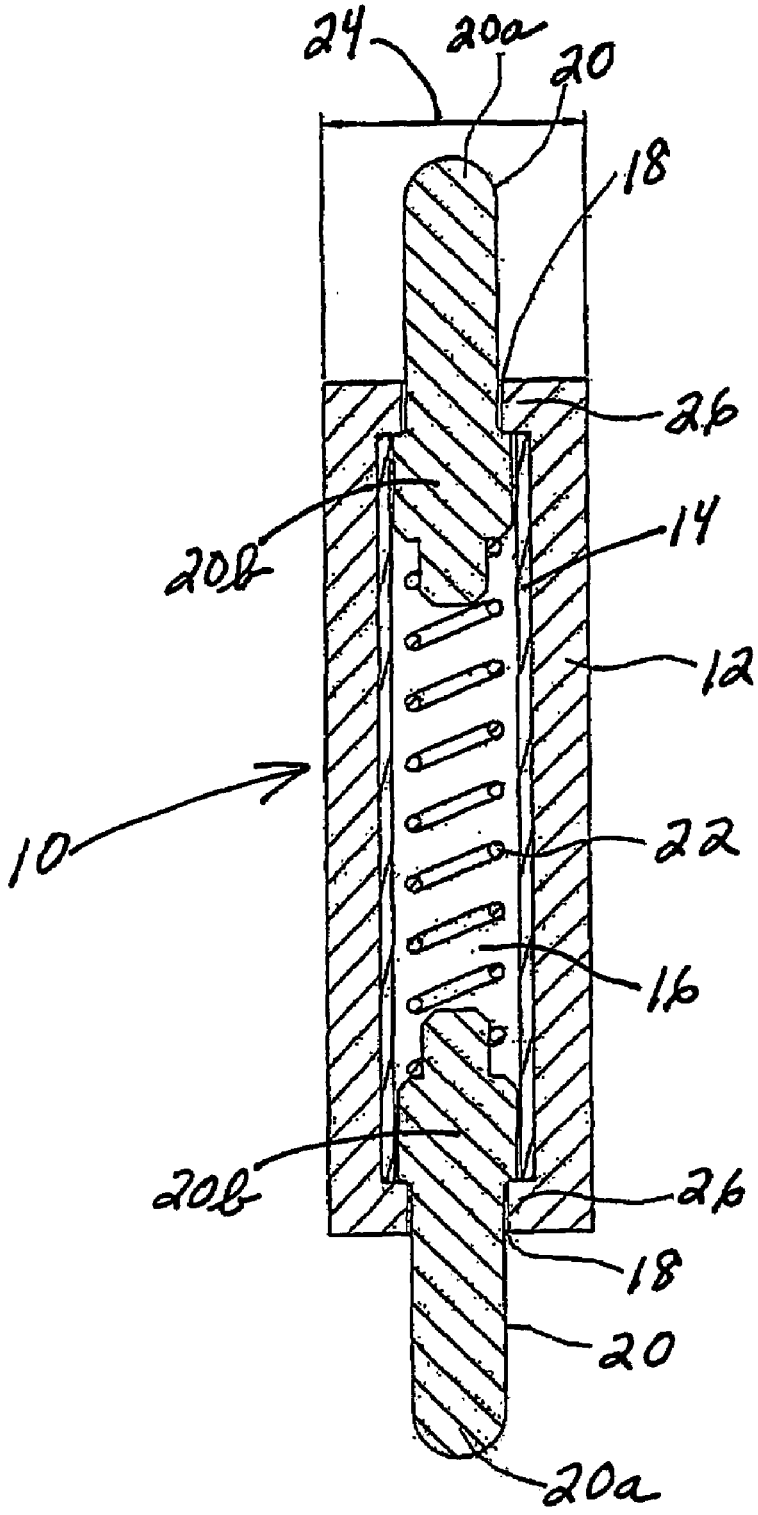
FIG. 1 (PRIOR ART)
FIG. 1 is a longitudinal or axial section through an electrical terminal according to the prior art and described in the Background, above.
Figure 2:
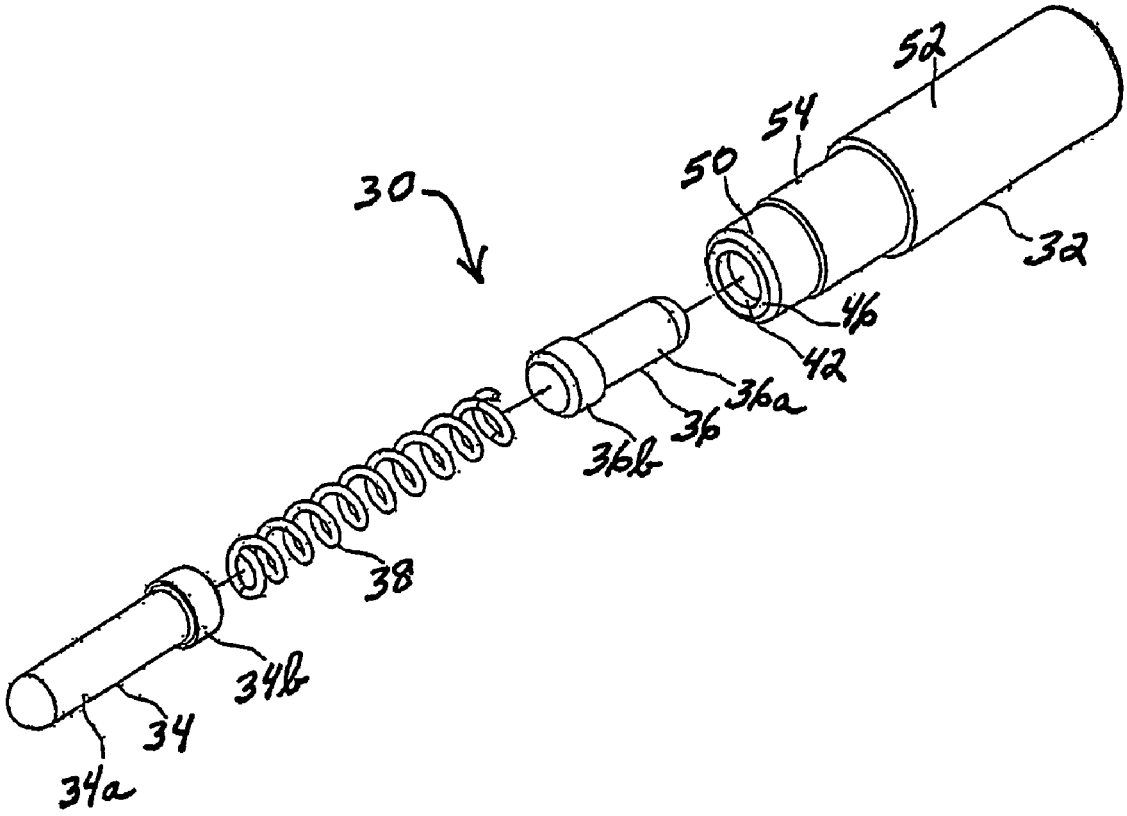
FIG. 2 is an exploded perspective view of an electrical terminal according to the invention.
Figure 3:
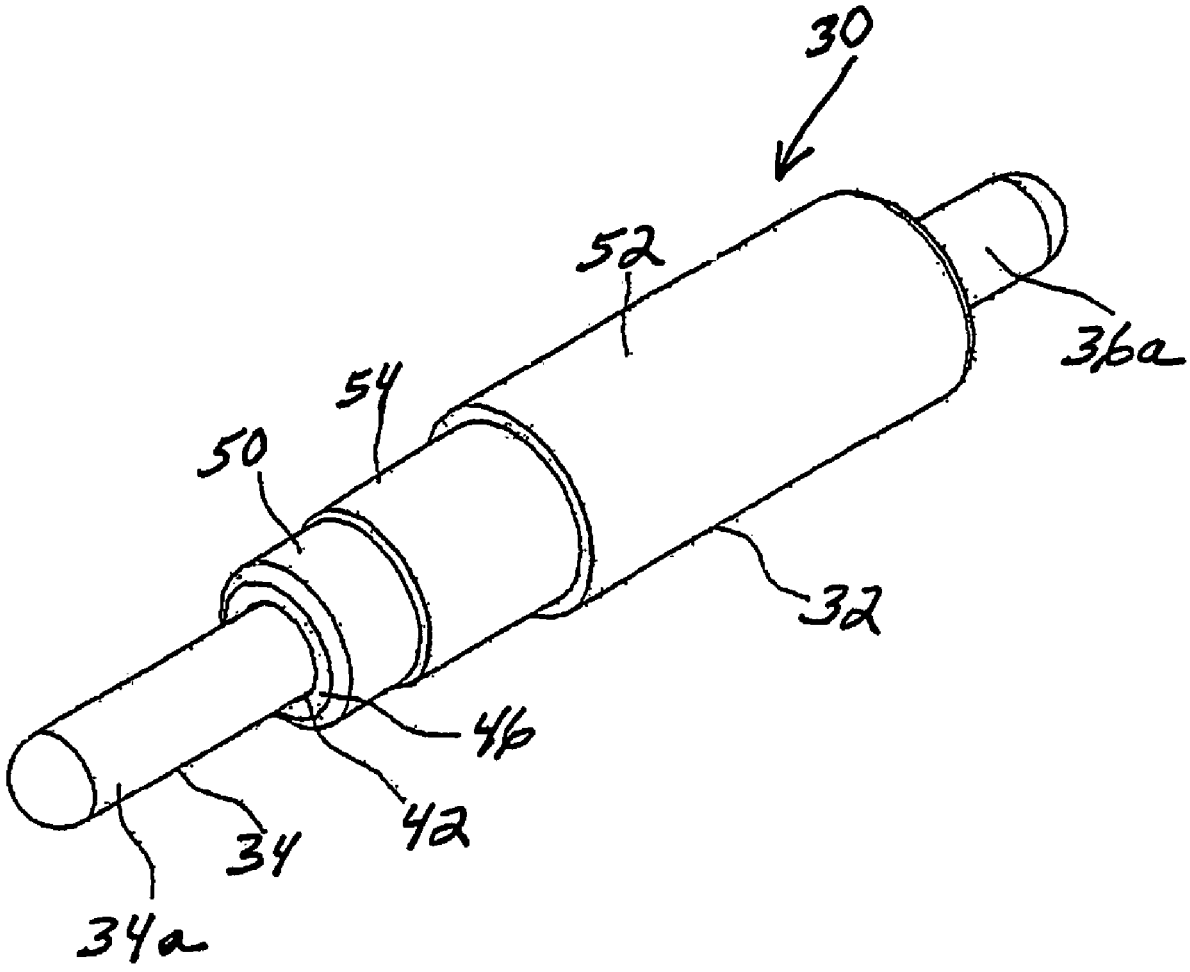
FIG. 3 is a perspective view of the terminal of FIG. 1 in assembled condition.
Figure 4:
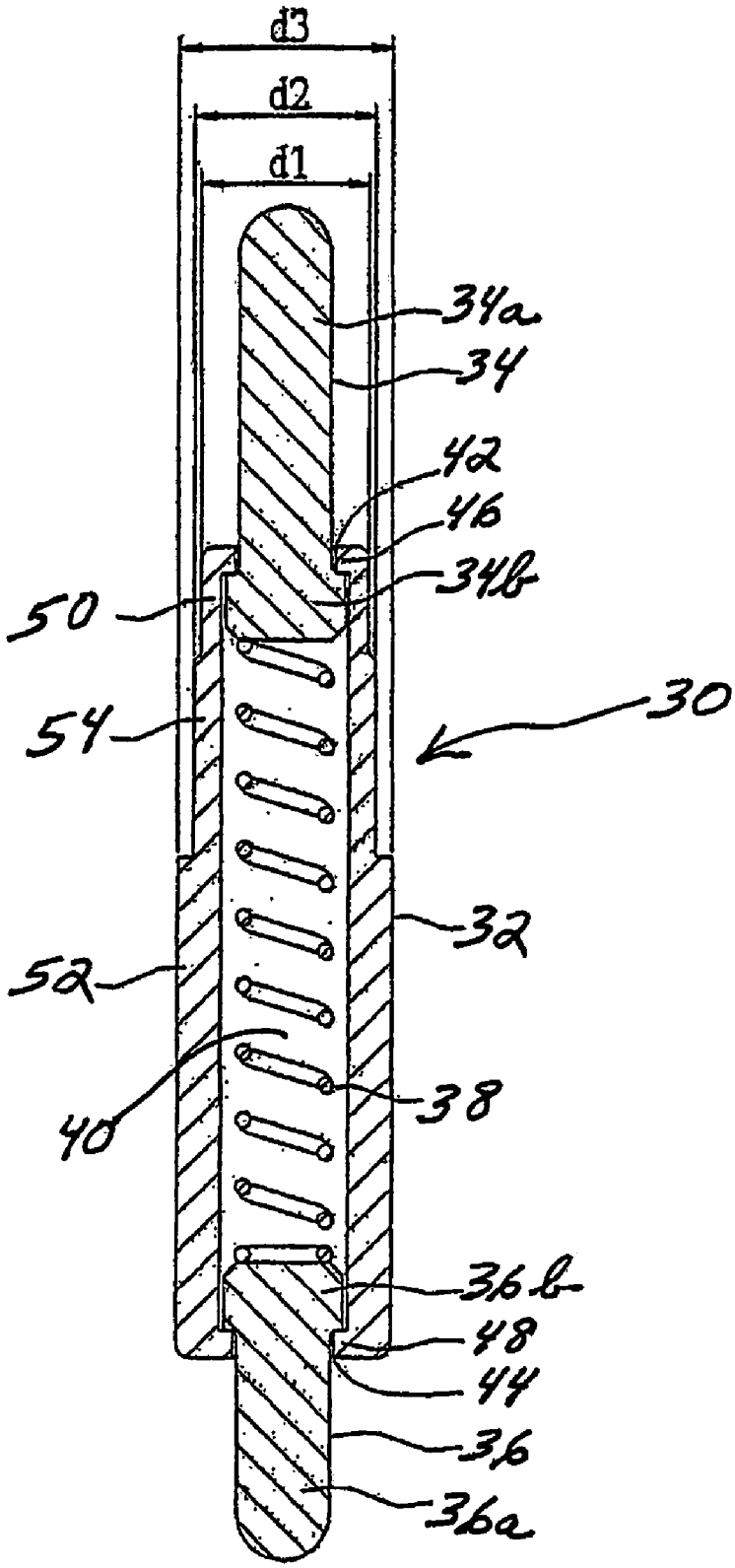
FIG. 4 is a longitudinal or axial section through the terminal.

Referring to the drawings in greater detail, and first to FIGS. 2-4, the invention is embodied in an electrical terminal, generally designated 30, which is extremely simple and includes only four components, namely: a sleeve 32, a first contact member 34 mounted at one end of the sleeve, a second contact member 36 mounted at an opposite end of the sleeve, and a coil spring 38 within the sleeve and biasing the contact members in opposite directions. The sleeve defines an elongated through hole 40 within which the coil spring is disposed.

More particularly, first contact member 34 includes an outer pressure contacting end portion 34*a* for pressure engaging a first electrical device as will be seen hereinafter. The first contact member includes an enlarged inner end portion 34*b*.

Second contact member 36 of terminal 32 has an outer pressure contacting end portion 36*a* for pressure engaging a second electrical device. The second contact portion also has an enlarged inner end portion 36*b*.

Through hole 40 of sleeve 32 slidably receives the inner end portions 34*b* and 36*b* of contact members 34 and 36, respectively. The through hole has a first open end 42 through which the pressure contacting end portion 34*a* of first contact member 34 projects. The through hole has a second open end 44 through which the pressure contacting end portion 36*a* of second terminal 36 projects. Sleeve 32 has first and second restricted stops 46 and 48, respectively, at the first and second open ends, respectively, of the through hole for abutting the enlarged inner ends 34*b* and 36*b*, respectively, of the contact members to define outer limit positions of the pressure contacting end portions of the contact members. Coil spring 38 abuts against the enlarged inner end portions 34*b* and 36*b* of the contact members to bias the contact members in opposite directions. It can be seen that the outer end portion 34*a* of first contact member 34 is longer than end portion 36*a* of second contact member 36.

The invention contemplates that at least the opposite ends of sleeve 32 be of different diameters and/or thicknesses. Specifically, as best seen in FIG. 4, a first end 50 of sleeve 32 is of a given or smaller diameter than a second end 52 of the sleeve. With the diameter of through hole 40 being constant throughout its length, first end 50 of the sleeve, thereby, is thinner than second end 52 of the sleeve. The diameter of first end 50 is indicated by double-headed arrow "d1", and the diameter of second end 52 of the sleeve is indicated by double-headed arrow "d3". In the preferred embodiment, the diameter of the sleeve is progressively varied by providing an intermediate section 54 which is larger than the diameter of first end 50 but smaller than the diameter of second end 52. The diameter of the intermediate section is indicated by double-headed arrow "d2". The sleeve can be fabricated of metal material and machined to provide the different diameters.

Figure 5:
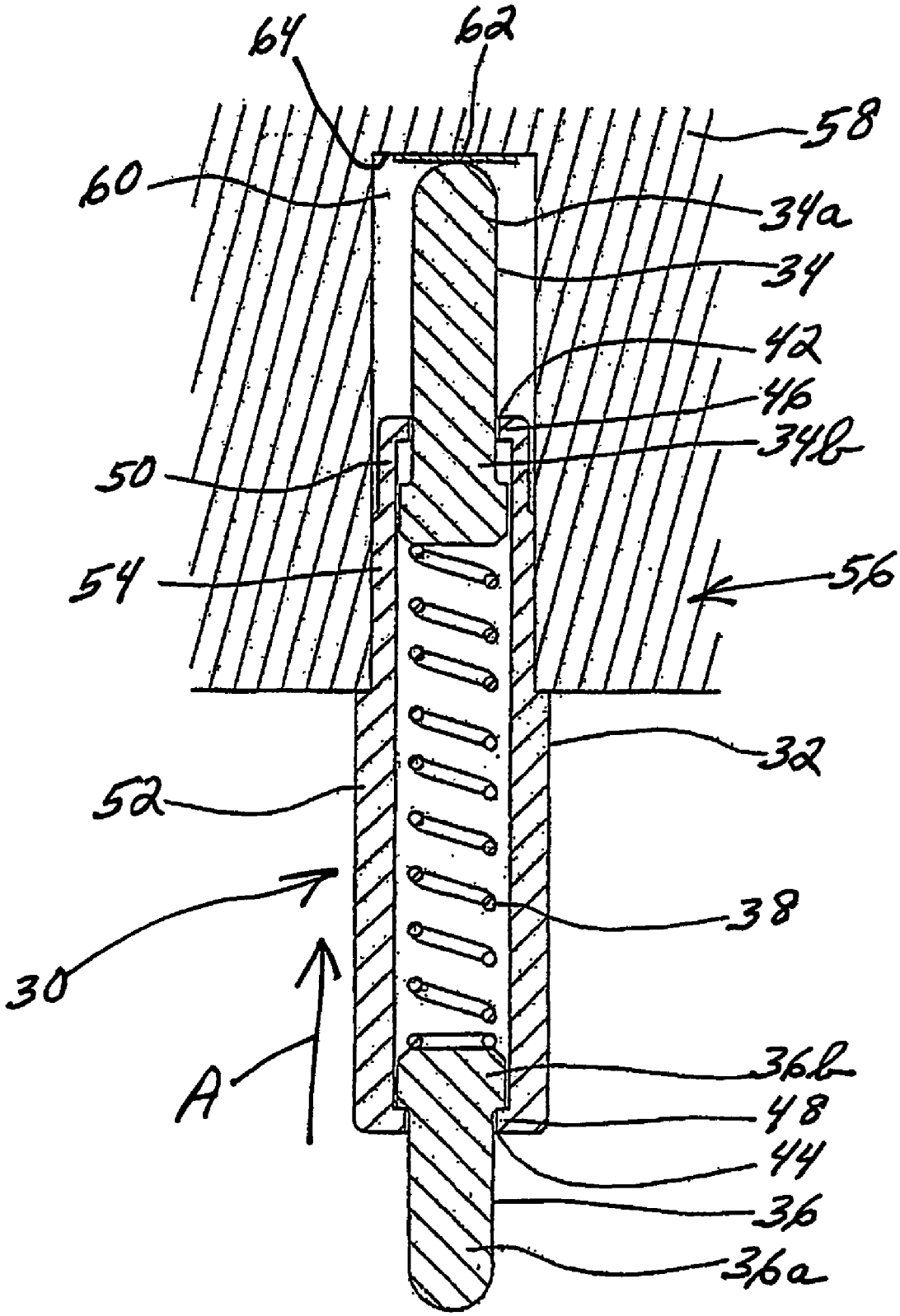
FIG. 5 is a view similar to that of FIG. 4, but showing the terminal mounted in an electrical device.

Referring to FIG. 5, the invention contemplates that terminal 30 can be assembled to an electrical device, generally designated 56 in the direction of arrow "A". The electrical device includes a housing 58 having a mounting cavity 60, with a fixed contact 62 at a base 64 of the cavity. Sleeve 32 is mounted into cavity 60 in the direction of arrow "A", with the smaller diameter first end 50 of the sleeve projecting into the cavity, and the larger diameter second end 52 of the sleeve projecting outside the cavity. The pressure contacting end portion 34*a* of first contact member 34 is resiliently biasingly engaged with fixed contact 62 at the base of the cavity by the pressure from coil spring 38. Intermediate section 54 of the sleeve bears against the inside walls of cavity 60, while the smaller diameter first end 50 of the sleeve can act as a lead-in to easily insert the sleeve into the cavity.

The advantages of the invention can best be seen by again referring to FIGS. 4 and 5. The restricted stop flange 48 at the wider or thicker end 52 of the sleeve can be easily preformed in an appropriate jig. Contact members 34 and 36 and coil spring 38 then are assembled into through hole 40 of sleeve 32. Restricted stop flange 46 then is formed by a riveting or bending operation. This riveting or bending procedure is facilitated by the "thinness" of the smaller diameter end 50 of sleeve 32. Once terminal 30 is mounted into cavity 60 of electrical device 56 as shown in FIG. 5, the thin or smaller diameter end 50 of sleeve 32 is protected within cavity 60. However, the more robust, thicker and wider diameter second end 52 of the sleeve is exposed exteriorly of the electrical device and can be clamped to remove the terminal, without damaging or crushing the thicker end of the sleeve.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical terminal (30), comprising:

a first contact member (34) having an outer pressure contacting end portion (34*a*) for pressure engaging a first electrical device (56) and an enlarged inner end portion (34*b*);

a second contact member (36) having an outer pressure contacting end (36*a*) portion for pressure engaging a second electrical device and an enlarged inner end portion (36*b*);

a sleeve (32) having a constant inner diameter and an outside diameter (d1) at a first end (50) thereof being smaller than an outside diameter (d3) at a second end (52) thereof and including an intermediate section (54) between said first and second ends (50,52) of the sleeve, the intermediate section having an outside diameter (d2) larger than the diameter of the first end of the sleeve but smaller than the diameter of the second end of the sleeve, the wall thickness at the first end (50) being thinner than the wall thickness at the second end (52) whereby a riveting or bend procedure at the first end can be facilitated by the thinness of the wall of the smaller diameter end (50);

a through hole (40) for slidably receiving the inner end positions of the first and second contact members;

said through hole having a first open end (42) through which the pressure contacting end portion of the first contact member projects and a second open end (44) through which the pressure contacting end portion of the second contact member projects;

restricted stops (46,48) at the first and second open ends of the through hole for abutting the enlarged inner ends of the contact members to define outer limit positions of the pressure contacting end portions of the contact members; and a biasing member (38) in the through hole of the housing to resiliently bias the contact members in opposite directions.

2. The electrical terminal of claim 1 wherein said restricted stops comprise inwardly turned flanges (46,48) of the sleeve (32) at said first and second open ends (42,44) thereof.

3. The electrical terminal of claim 1 wherein the outer pressure contacting end portion (34*a*) of said first contact member (34) is dome shaped to present a rounded convex contact surface for engaging the first electrical device.

4. The electrical terminal of claim 1 wherein the outer pressure contacting end portion (36*a*) of said second contact member (36) is dome shaped to present a rounded convex contact surface for engaging the second electrical device.

5. The electrical terminal of claim 4 wherein the outer pressure contacting end portion (34*a*) of said first contact member (34) is dome shaped to present a rounded convex contact surface for engaging the first electrical device.

6. In combination with the electrical terminal of claim 1, said first electrical device (56) including a housing (58) having a mounting cavity (60) with a fixed contact (62) at a base (64) of the cavity, said sleeve (32) being mounted in the cavity with the smaller diameter first end (50) of the sleeve projecting into the cavity and the larger diameter second end (52) of the sleeve projecting outside the cavity, and with the pressure contacting end portion (34*a*) of the first contact member (34) resiliently biasingly engaging the fixed contact at the base of the cavity.

7. The combination of claim 6 wherein said intermediate section (54) of the sleeve (32) bears against inside walls of said mounting cavity (60), leaving the smaller diameter first end (50) of the sleeve spaced inwardly of the inside walls of the cavity.

* * * * *